United States Patent [19]

Wilkins

[11] Patent Number: 4,776,595

[45] Date of Patent: Oct. 11, 1988

[54] GOLF CLUB GRIP POSITIONING AID

[76] Inventor: Judd R. Wilkins, 281 Littleton Quarter, Williamsburg, Va. 23185

[21] Appl. No.: 69,133

[22] Filed: Jul. 2, 1987

[51] Int. Cl.[4] ..... A63B 69/36

[52] U.S. Cl. ..... 273/183 B; 2/161 A

[58] Field of Search ..... 273/183 B, 165, 166, 273/188 R; 2/161 A

[56] References Cited

U.S. PATENT DOCUMENTS

| | | | |
|---|---|---|---|
| 3,348,238 | 10/1967 | Hydock | 2/161 |
| 3,508,280 | 4/1970 | Osborn | 2/159 |
| 3,532,344 | 10/1970 | Masstab | 273/166 |
| 3,559,212 | 2/1971 | Skovron | 2/161 |
| 3,848,874 | 11/1974 | Elkins, Jr. | 273/183 B |
| 4,488,726 | 12/1984 | Murray | 2/160 |
| 4,637,612 | 1/1987 | Wilkins | 273/183 B |

FOREIGN PATENT DOCUMENTS

| | | | |
|---|---|---|---|
| 686465 | 3/1965 | Italy | 273/183 B |

*Primary Examiner*—George J. Marlo

*Attorney, Agent, or Firm*—Griffin, Branigan & Butler

[57] ABSTRACT

A club swing indicator (10) to be used with a grip-improving glove (32) includes a thin flat base (12) having an approximate shape of the outline of a person's finger with a raised, relatively sharp, indicator element (18) mounted on one side thereof. The indicator is placed in a finger portion of the grip-improving glove and is oriented such that the indicator element impinges on the bottom of a person's finger which is in the glove. Thus, the indicator element is between the finger and a club gripped by the finger. Exceptional pressure between the finger and the club causes the indicator element to be thrust into the finger thereby causing a sharp sensation in the finger to indicate that the exceptional pressure has taken place.

7 Claims, 1 Drawing Sheet

GOLF CLUB GRIP POSITIONING AID

BACKGROUND OF THE INVENTION

This invention relates generally to the art of club-swing instructional aids and more specifically to instructional aids for golf clubs.

It has long been recognized that a person's hand grip on a club, particularly a golf club, throughout a swing, including backswing and forward swing, strongly influences the results attained by the swing. In this regard, U.S. Pat. Nos. 3,348,238 to Hydock, 3,508,280 to Osborn, and several other U.S. patents have involved placing Velcro and Velcro-like devices on club handles and gloves to improve a golfer's grip on his club. It is an object of this invention to provide a club swing indicator which gives to a sportsman an indication that a finger is being properly used at a particular point in a swing.

U.S. Pat. No. 3,848,874 discloses a golf glove system indicating to a golfer when his hand is in a proper position on a golf club at the beginning of a swing. It is an object of this invention to provide an indicator device which indicates to a golfer whether one or more of his fingers are appropriately positioned and are applying appropriate pressures at particular points in a swing.

U.S. Pat. No. 4,488,726 to Murray discloses a training glove which includes pressure actuated switches for alarm circuits in each of the fingers of the glove. When a club is properly gripped the switches are held open. However, if the club is improperly gripped the pressure on one or more of the switches will fall below a predetermined threshold and these switches will close so that an alarm is actuated. It is an object of this invention to provide a club swing indicator which provides only one indication at a particular point in a swing to inform a club swinger that one of his fingers is properly performing the swing.

It is also an object of this invention to provide a club swing indicator which can be used with existing gloves and which is therefore inexpensive to construct and uncomplicated to use.

SUMMARY

According to principles of this invention, a club swing indicator which can be added to existing gloves comprises a relatively flat, thin, rigid base having an approximate shape of the outline of a person's finger and a raised relatively sharp indicator element mounted on a top side of the flat base for impinging on and thrusting into the bottom of a person's finger at a particular point during a club swing. In this regard, the indicator is inserted into the finger portion of a grip-improving glove and is oriented so that the relatively sharp indicator element impinges on the bottom of the person's finger. Exceptional pressure between the finger and the club causes the indicator element to be thrust into the finger and thereby causes a sharp sensation in the finger. The indicator element is constructed of a fold in loop type fastener material with a rigid support strip in the fold.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figure 1:
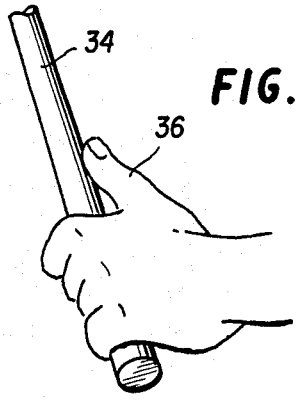
FIG. 1 is an isometric view of a right-handed golfer's ungloved left hand gripping the handle of a golf club.
Figure 3:
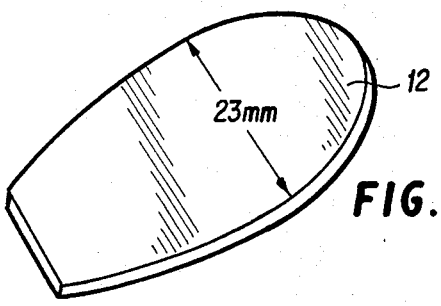
FIG. 3 is an isometric view of a flat base of the club-swing indicator of FIG. 2.
Figure 5:
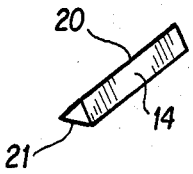
FIG. 5 is an isometric view of a support strip used in the club-swing indicator of FIGS. 2 and 4.
Figure 4:
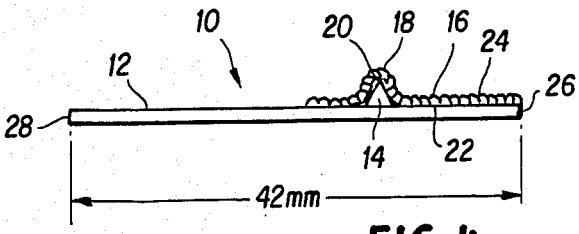
FIG. 4 is a side view of a club-swing indicator of this invention.

It is generally recognized that to consistently hit a golf ball straight a golfer's grip on a club must be in a "neutral position", that is, a position with the palms of both hands facing each other and matching the angle of a club face. This neutral position requires that a club handle be placed under the left heel pad of the left hand and then gripped with all fingers except the thumb. When the hand is closed, the club is firmly supported between the heel pad and these fingers with the left thumb lying on top of the golf club shaft, positioned slightly to the right of center, as is shown in FIG. 1. The palm of the right hand then fits snugly over the left thumb.

During a backswing of the golf club, movement of the golfer's body and arms serves to put the club on a correct plane at the top of his swing with the club and left thumb being relatively repositioned such that the thumb is now under the club shaft. Failure to have the left thumb in this position results in a number of faults. If, on the other hand, the thumb is directly under the shaft at the top of the swing, one can support the momentum of the club as he pulls down with his left arm from the inside during the subsequent forward swing. This invention aids a golfer in properly relatively positioning the club and the left thumb at the top of the swing.

A club-swing indicator insert 10 comprises a relatively hard, thin, resinous plastic base 12, an elongated, triangularly-shaped in cross-section, support strip 14 positioned and cemented on the insert base 12, and a small piece of fastener material 16 covering a portion of the base 12 and the support strip 14.

Looking in more detail at the base 12, it is relatively flat having an approximate shape of the outline of the outer link of a human left thumb. In this regard, the shape and dimensions of the base 12 can vary somewhat, governed by gender, age and possibly other factors of the users thereof. Inserts of the type described herein could be sold by size or according to some other classifications. The plastic base is approximately 1.0 mm thick and although it is sufficiently rigid to support the triangular support strip 14 and the fastener covering 16, it is also sufficiently flexible to conform somewhat to a sportsman's thumb to allow appropriate movement of the thumb relative to a club gripped therewith.

With regard to the support strip 14, the purpose of this is mainly to hold the fastener covering 16 to have a relatively sharp ridge 18. This ridge should be approximately 5.0 mm in height. If the support strip 14 were not present, the fastener covering ridge 18 would collapse and would not provide a proper sentation to a sportman's thumb as will be described below. The support strip 14 can be of balsam wood so as to provide a light weight but other materials could also be used. The support strip 14 is adhered to the base 12 with one apex 20 of its triangular shape pointed upwardly and a side 21 of the triangular shape being mounted on the base 12. Preferably, the support strip 14 is placed from side edge to side edge across the base 12 rather than along the length thereof for providing proper sensations during a club swing but yet not providing discomfort or undue rubbing on a user's finger. However, other relative positions of the support strip 14 could also be used.

The fastener covering 16 is a hook-type fastening material of a hook-loop fastening pair with the hooks 24 thereof extending upwardly. This material is comprised of cloth-type backing 22 with the hooks 24 extending upwardly therefrom. There are a number of hook-loop fasteners on the market, the best known of which being sold under the trademark VELCRO. In the preferred embodiment, the fastening covering 16 covers the outer tip of the base 12 and the support strip 14, which is positioned across an outer-tip portion of the base 12; however, the fastening cover 16 does not extend to an inward end 28 of the base 12. The reason for this is that fastener covering at the inward end would tend to distract from desired sensations caused by the sharp ridge 18, however, it is desired to have the base 12 a sufficient length to extend to about the first joint of a thumb for properly holding the insert 10 in postion in the thumb portion of a glove.

Figure 2:
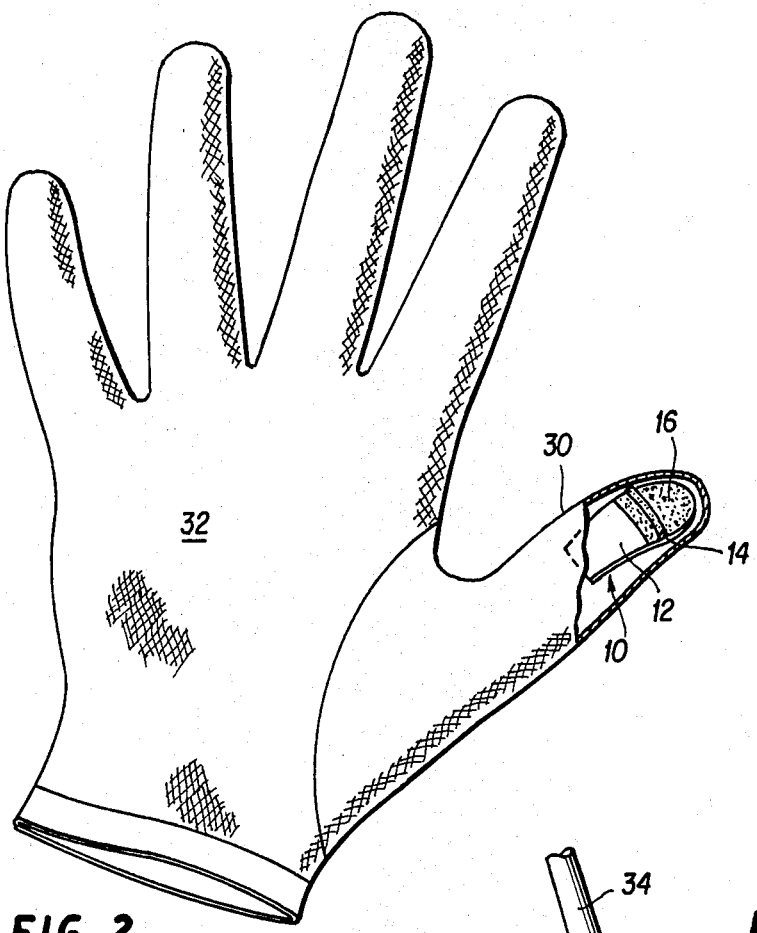
FIG. 2 is a partially cut-away isometric view of a golf glove containing a club-swing indicator of this invention.

In operation, a sportsman purchases an insert 10 and inserts it in a left thumb portion of a club-gripping glove 32 as is shown in FIG. 2. The user then inserts his hand into the club glove 32 with the bottom of his left thumb being positioned firmly on top of the sharp ridge 18. The sportsman, if he is a golfer, then grips a golf club handle 34 (FIG. 1) with his thumb approximately on top of the handle 34 (as is shown in FIG. 1 without the glove). When the golfer makes his backswing, his left thumb 36 and the club should be reoriented so that the thumb is positioned on the bottom of the handle at the top of the back swing. If this is the case, as it should be, the end of the club is now supported primarily by the left thumb and the golfer should feel a rather sharp, but not uncomfortable, sensation in his left thumb at the top of the swing. In this regard, the hook-type fastening material is soft yet provides the sharp sensation.

It will be appreciated by those of ordinary skill in the art that by providing a clearly discernable sensation when the golfer's left thumb is in a proper position at the top of the swing prevents the golfer from "casting" or "throwing" the club at the top of the backswing and in general instils in the golfer a sense of a strong left side in the swing.

While the invention has been particularly shown and described with reference to a preferred embodiment, it will be understood by those skilled in the art that various changes in form and detail may be made therein without departing from the spirit and scope of the invention. For example, another material could be used rather than the fastener-covering material 16, however, the fastener-covering material is an "off-the-shelf" item which works quite well for this invention. Also, it is obvious that the insert of this invention can also be used with the right thumb of a left handed golfer. Further, the insert could be used with other fingers to indicate points of maximum pressure between those fingers and a club at particular points in a swing.

The embodiments of the invention in which an exclusive property or privilege are claimed are defined as follows:

1. A combination of grip-improving glove and a club swing indicator, said combination comprising:

a grip-improving glove having a plurality of hollow finger portions for receiving fingers to be used for gripping a club;

an indicator comprising a relatively flat base having an approximate shape of the outline of a person's finger, said flat base being sufficiently rigid to serve as a support for a raised indicator element when it is impinged on by a finger but sufficiently flexible to bend to the contour of a person's finger;

said indicator further comprising a raised indicator element mounted on a first side of said flat base for protruding upwardly therefrom and impinging on and thrusting into the bottom of a person's finger when said swing indicator and said finger are in said glove together;

said indicator being mounted in a finger portion of said grip-improving glove with its shape being oriented in the same manner as the outlining of a person's finger inserted in the finger portion, a person's hand being inserted into the glove with the bottom of the person's finger impinging on said indicator element so that said indicator element lies between said finger and a club gripped by said hand, whereby exceptional pressure between said finger and said club causes said indicator element to be thrust into said finger and thereby causes a sharp sensation to the finger to indicate an increased pressure between the club and the finger.

2. A combination as in claim 1, wherein said indicator element is comprised of a fold in cloth-like material.

3. A combination as in claim 2, wherein said cloth-like material is a complementary half of a hook and loop fastener.

4. A combination as in claim 3, wherein said complementary half is the hook complementary half.

5. A combination as in claim 3, wherein said base is formed of a sheet of hard plastic which is sufficiently hard for maintaining sufficient rigidity of the base to serve as said support for said raised indicator element to thrust it into a finger when it is impinged on by a finger.

6. A combination as in claim 2, wherein is further included a relatively rigid support strip positioned under the fold of a cloth-like material between the cloth-like material and the flat base for providing vertical support for said fold.

7. A combination as in claim 1 wherein said glove includes a thumb finger portion and wherein said indicator element is mounted in said thumb finger portion.

* * * * *